US007202408B2

(12) United States Patent
Fallgatter

(10) Patent No.: US 7,202,408 B2
(45) Date of Patent: Apr. 10, 2007

(54) METHODS AND ELECTRONIC SYSTEMS FOR FINGERING ASSIGNMENTS

(76) Inventor: James Calvin Fallgatter, 207 Cobblestone La., Ridgecrest, CA (US) 93555

( * ) Notice: Subject to any disclaimer, the term of this patent is extended or adjusted under 35 U.S.C. 154(b) by 35 days.

(21) Appl. No.: 11/111,638

(22) Filed: Apr. 21, 2005

(65) Prior Publication Data

US 2005/0235812 A1 Oct. 27, 2005

Related U.S. Application Data

(60) Provisional application No. 60/564,347, filed on Apr. 22, 2004, provisional application No. 60/564,399, filed on Apr. 22, 2004, provisional application No. 60/564,400, filed on Apr. 22, 2004, provisional application No. 60/564,412, filed on Apr. 22, 2004, provisional application No. 60/564,464, filed on Apr. 22, 2004, provisional application No. 60/605,221, filed on Aug. 27, 2004.

(51) Int. Cl.
*G10H 7/00* (2006.01)

(52) U.S. Cl. ..... 84/645; 84/609; 84/615; 84/423 R

(58) Field of Classification Search ..... 84/645, 84/609, 719, 423 R, 615, 656, 649, 477 R
See application file for complete search history.

(56) References Cited

U.S. PATENT DOCUMENTS 4,352,313 A 10/1982 Ny
4,655,117 A 4/1987 Roose
4,704,940 A 11/1987 Cummings
5,036,745 A 8/1991 Althof, Jr.
5,088,378 A * 2/1992 DeLaTorre ..... 84/470 R
5,565,641 A * 10/1996 Gruenbaum ..... 84/615
5,597,971 A * 1/1997 Saito ..... 84/669
5,619,003 A 4/1997 Hotz
5,646,648 A * 7/1997 Bertram ..... 345/168
5,741,990 A * 4/1998 Davies ..... 84/423 R
5,783,764 A * 7/1998 Amar ..... 84/479 A
5,883,325 A 3/1999 Peirce (Continued)

OTHER PUBLICATIONS

August Dvorak et al., *Typewritting Behavoir*, 1936, American Book Company (including title page, table of contents, pp. 210-215,218-223, 232, 233, 324, 325, 346-349, 378, 379, and index) (26 total pages).

*Primary Examiner*—Lincoln Donovan
*Assistant Examiner*—Christina Russell
(74) *Attorney, Agent, or Firm*—Knobbe, Martens, Olson & Bear, LLP

(57) ABSTRACT

Embodiments of the disclosure relate to assignment of fingering for performance of a musical piece. In one example, a processor of an electronic system receives a file having data relating to at least one musical piece. The processor parses the file and assigns keys to occurrences of notes within the musical piece. In certain embodiments, the key-to-note assignments are based on predetermined factors, such as common patterns of learned fingering and a user typing proficiency level, and/or predetermined assignment rules, such as physical or spatial limitations with respect to the user's fingers and the keys of the keyboard. Furthermore, embodiments of the invention allow for different keys to be assigned to different occurrences of the same note or allow for a single key to be assigned to multiple notes, such as a chord, or to different notes occurring at different points in the musical piece.

12 Claims, 5 Drawing Sheets

U.S. PATENT DOCUMENTS 5,883,825 A * 3/1999 Kolagotla ..... 708/626
5,902,949 A 5/1999 Mohrbacher
6,063,994 A 5/2000 Kew et al.
6,066,795 A * 5/2000 Hara ..... 84/645
6,078,005 A 6/2000 Kurakake et al.
6,087,577 A 7/2000 Yahata et al.
6,118,065 A 9/2000 Haruyama
6,166,314 A 12/2000 Weinstock et al.
6,229,082 B1 5/2001 Masias
6,231,347 B1 5/2001 Tsai
6,351,225 B1 2/2002 Moreno
6,420,641 B1 7/2002 Kuan
6,444,888 B1 * 9/2002 VanDruff ..... 84/609
6,444,889 B1 * 9/2002 Yahata ..... 84/634
6,495,748 B1 12/2002 Wang et al.
6,850,225 B1 * 2/2005 Whitcroft ..... 345/168

* cited by examiner

METHODS AND ELECTRONIC SYSTEMS FOR FINGERING ASSIGNMENTS

REFERENCE TO RELATED APPLICATIONS

The present application claims the benefit of priority under 35 U.S.C. § 119(e) of the following provisional applications, each of which is hereby incorporated herein by reference in its entirety:

- U.S. Provisional Application No. 60/564,347, filed on Apr. 22, 2004, and entitled "GRAPHICAL USER INTERFACE FOR DISPLAYING MUSICAL COMPOSITION";
- U.S. Provisional Application No. 60/564,399, filed on Apr. 22, 2004, and entitled "SYSTEM AND METHOD FOR PERFORMING MULTIMEDIA APPLICATION";
- U.S. Provisional Application No. 60/564,400, filed on Apr. 22, 2004, and entitled "GRAPHICAL REPRESENTATION OF MUSICAL EVENT";
- U.S. Provisional Application No. 60/564,412, filed on Apr. 22, 2004, and entitled "SYSTEM AND METHOD OF KEY ASSIGNMENT";
- U.S. Provisional Application No. 60/564,464, filed on Apr. 22, 2004, and entitled "SYSTEM AND METHOD OF FILE CONVERSION"; and
- U.S. Provisional Application No. 60/605,221, filed on Aug. 27, 2004, and entitled "SYSTEM AND METHOD FOR PERFORMING MULTIMEDIA APPLICATION ON HANDHELD DEVICE."

BACKGROUND

1. Field of the Invention

The present disclosure relates to methods and electronic systems for performing music and, in particular, to assigning fingering to notes of a musical piece.

2. Description of the Related Art

Music is enjoyed by millions. To be capable to correctly perform musical pieces, however, one must generally dedicate a substantial amount of time and effort to practicing. For example, one may learn to become familiar with and read musical score, which is often presented in traditional music notation or a variation thereof. One may also learn the intricacies of and practice with a musical instrument that requires the user to engage in particular hand or finger movements or to breathe in a particular manner such that the musical instrument plays the appropriate notes. This learning generally requires a considerable amount of practice and can be a substantial financial expense, which causes up to 80–85% of individuals to quit before really learning how to play the instrument.

In addition to traditional musical instruments, some computer programs allow persons to compose music using keyboards, keypads or other input devices. Many of these conventional programs generally allow a user to play sequences of notes using a standard QWERTY keyboard, wherein each of a plurality of keys has a fixed assignment to a particular note (i.e., an "E" key always plays an "E" note). Such key assignments are also generally the same for all musical pieces executed by the program, independent of the particular user or the musical piece being played. As with learning to play a traditional musical instrument, these computer programs can also require a considerable amount of practice to learn the proper key sequences and/or key assignments and, in most cases, traditional notation in order to perform a musical piece. Furthermore, due to the variety of note sequences found in music, fixed key/note assignments can easily and often lock the performer into implausible, or even impossible, fingering or hand configurations.

SUMMARY

In view of the foregoing drawbacks, certain embodiments of the invention facilitate the performance of musical pieces on an electronic system. Furthermore, some embodiments of the invention utilize and adapt to already-developed typing skills of a user when assigning fingering for the performance of musical pieces.

In certain embodiments, these assignments include a "floating fingering" approach such that different occurrences of the same note during the musical piece can be mapped to different keys of the keyboard. That is, the key-to-note assignment may depend on, at least in part, the point at which the note occurs within the musical piece.

For example, certain embodiments of the disclosure relate to assignment of fingering for the performance of a musical piece. In one embodiment, a processor of an electronic system receives a file having data relating to at least one musical piece. The processor parses the file and assigns keys to occurrences of notes within the musical piece. In certain embodiments, the key-to-note assignments are based on predetermined factors, such as common patterns of learned fingering and a user typing-proficiency level, and/or predetermined assignment rules, such as physical or spatial limitations with respect to the user's fingers and the keys of the keyboard. Furthermore, one or more embodiments of the invention allow for different keys to be assigned to different occurrences of the same note or allow for a single key to be assigned to multiple notes, such as a chord, or to different notes occurring at various points in the musical piece.

One embodiment of the invention includes a method of assigning keyboard fingering for a performance of a musical piece. The method comprises: receiving a file comprising data associated with a plurality of notes of a musical piece and assigning a first key having a first position on a keyboard to a first note of the plurality of notes, wherein the first note has a first pitch. The method further comprises assigning a second key having a second position on the keyboard to a second note of the plurality of notes, wherein the second note has the same pitch as the first note and wherein the assigning of the second key comprises at least determining a positional relationship between the second key and another key on the keyboard.

Another embodiment of the invention includes a method of assigning keyboard fingering for a performance of a musical piece. The method includes receiving a file comprising data associated with a plurality of notes of a musical piece and assigning a first key of a keyboard to a first note of the plurality of notes, wherein the first note has a first pitch. The method further includes assigning the first key to a second note of the plurality of notes, wherein the second note has a different pitch than the first note and wherein the assigning of the first key to the second note comprises at least determining a positional relationship between the first key and another key on the keyboard.

Another embodiment of the invention includes a machine loadable software program capable of assigning fingering for a performance of a musical piece. The software program includes first software instructions capable of assigning a first key having a first location on a keyboard to an occurrence of a first note of a musical piece; second software instructions capable of assigning a second key having a second location on the keyboard to an occurrence of a second note of the musical piece; and third software instructions capable of determining if the first location and the second location comprise an implausible key combination.

Another embodiment of the invention includes a system for assigning keyboard fingering. The system comprises means for receiving a file comprising data associated with a plurality of notes of a musical piece and means for assigning a first key having a first position on a keyboard to an occurrence of a first note of the plurality of notes. The system further comprises means for assigning a second key having a second position on the keyboard to an occurrence of a second note of the plurality of notes, wherein the means for assigning the second key comprises determining at least a relationship between the first position and the second position.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE PREFERRED EMBODIMENTS

Certain embodiments of the invention described herein include systems and methods for assigning fingering to notes of a musical piece. For example, in certain embodiments, a system and method utilize an algorithm to assign, or map, a key of a keyboard to a particular occurrence of at least one note within the musical piece. In some embodiments, these assignments include a "floating fingering" approach such that different occurrences of the same note during the musical piece can be mapped to different keys of the keyboard.

In one embodiment, the assignments may take into account a variety of factors to assign a key to a particular occurrence of a note. For example, the system may advantageously make key-to-note assignments according to keyboard fingering principles, proprioceptive conditions, procedural neuromuscular conditioning or learning, combinations of the same, and like factors.

In certain embodiments, the systems and methods described herein can advantageously be implemented using computer software, hardware, firmware, or any combination of software, hardware, and firmware. In certain embodiments, the system is implemented as a number of software modules that comprise computer executable code for performing the functions described herein. In certain embodiments, the computer-executable code is executed on one or more general purpose computers. Modules that can be implemented using software to be executed on a general purpose computer can also be implemented using a different combination of hardware, software, or firmware.

The term "pitch" as used herein is a broad term and is used in its ordinary sense and includes, without limitation, the property of a sound (such as a musical tone) that is determined at least in part by the frequency of the waves producing it. For example, a pitch may refer to the highness or lowness of a sound.

The term "note" as used herein is a broad term and is used in its ordinary sense and includes, without limitation, any pitch or audible sound, such as produced by a device, an instrument, and/or an animal.

The term "musical piece" as used herein is a broad term and is used in its ordinary sense and includes, without limitation, any sequence of notes, such as, for example, a musical composition, a song (with or without lyrics), ring tones, combinations of the same, and the like.

The features of the inventive systems and methods will now be described with reference to the drawings. Throughout the drawings, reference numbers are re-used to indicate correspondence between referenced elements. The drawings, associated descriptions, and specific implementation are provided to illustrate embodiments of the invention and not to limit the scope of the invention.

Figure 1:
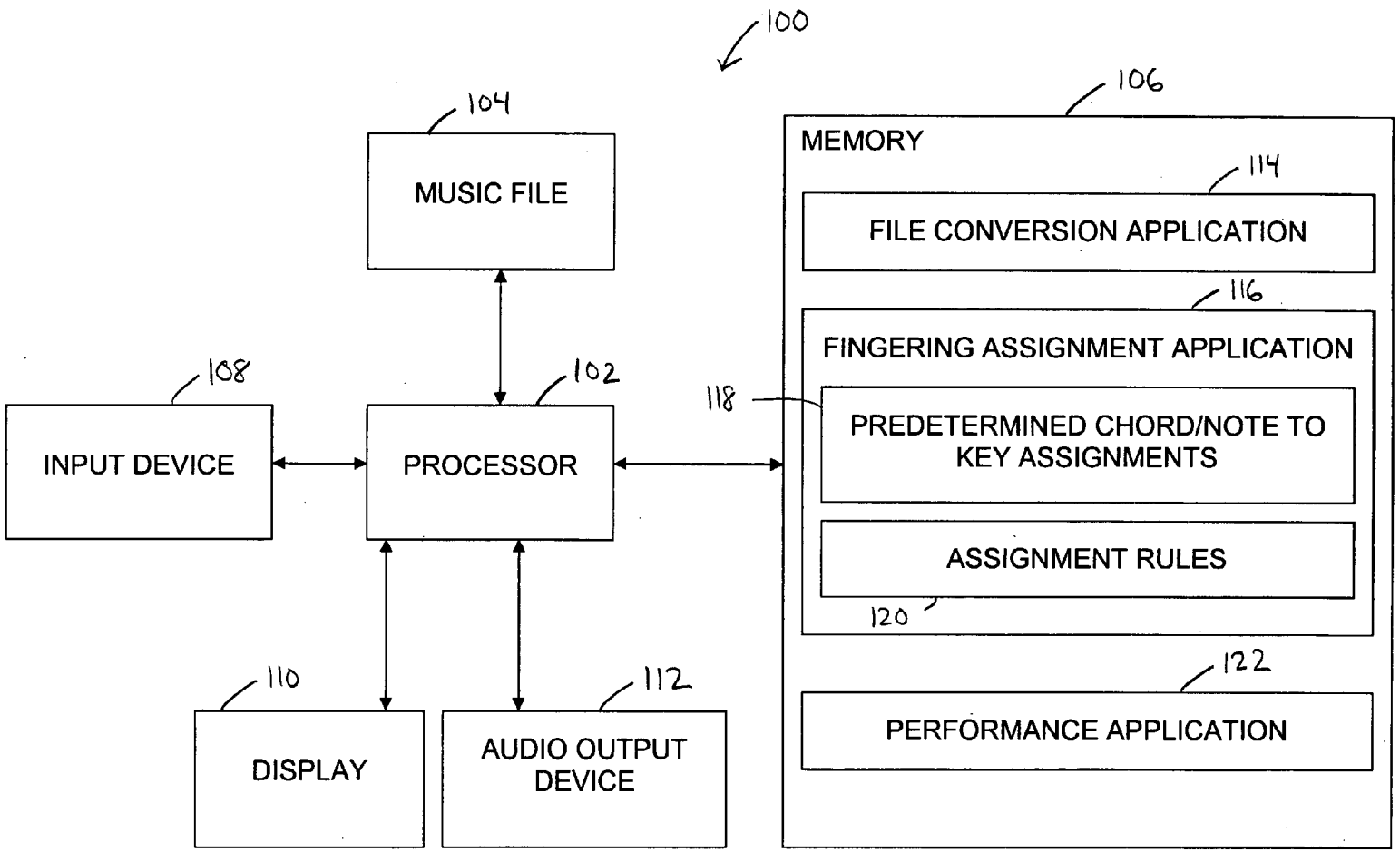
FIG. 1 illustrates a block diagram of an electronic music system according to an embodiment of the invention.

FIG. 1 illustrates a block diagram of an electronic music system 100 according to certain embodiments of the invention. In one embodiment, the music system 100 comprises a general personal computing platform, such as, for example, a personal computer executing a DOS®, Windows®, OS/2®, Macintosh®, Linux, or UNIX-based operating system. The illustrated music system 100 includes a processor 102 configured to receive a music file 104 including data associated with a musical piece for performance by a user. As illustrated, the processor 102 communicates with a memory 106, an input device 108, a display 110, and an audio output device 112.

The processor 102 comprises any computing device capable of controlling at least a portion of the music system 100, such as by processing input received from a user and outputting data for the performance of a musical piece. In other embodiments of the invention, the processor 102 may comprise one or more modules configured to execute on one or more processors. The modules may comprise, but are not limited to, any of the following: hardware or software components such as software object-oriented software components, class components and task components, processes, methods, functions, attributes, procedures, subroutines, segments of program code, drivers, firmware, microcode, applications, algorithms, techniques, programs, circuitry, data, databases, data structures, tables, arrays, variables, combinations of the same, or the like.

The music file 104 includes data that is readable by the processor 102 and that contains information relating to at least one musical piece. For example, the music file 104 may comprise data in one or more of the following formats or protocols: scanned music; audio files including, but not limited to, files with one of the following file extensions: .AIFF, .ASF, .AU, .AVI, .CDA, .CDR, .CMF, .DEWF, .DIG, .DMF, .DSF, .DSM, .FZB, .FZF, .FZV, .GSM, INS, .MPEG, .MP2, .MP3, .MWS, .RA, .RAM, .RAW, .SBI, .SDS, .SOU, .SYX, .SYW, .TXW, .VOC, .W01, .WAV, and like audio file file extensions; ABC files; ring tones; karaoke files (e.g., .KAR, .MID+, .TXK, .CRT, .ST3); musical instrument digital interface (MIDI) files; combinations of the same or the like.

In certain embodiments, the processor 102 communicates with the memory 106 to retrieve and store data and/or program instructions for software and/or hardware. As illustrated in FIG. 1, the memory 106 is configured to store a file conversion application 114; a fingering assignment application 116, which further includes predetermined chord/key-to-note assignments 118 and assignment rules 120; and a performance application 122.

In certain embodiments, the memory 106 may comprise random access memory (RAM), ROM, on-chip or off-chip memory, cache memory, or other more static memory such as magnetic or optical disk memory. The memory 106 may also access and/or interact with CD-ROM data, personal digital assistants (PDAs), cellular phones, laptops, portable computing systems, wired and/or wireless networks, customized musical devices to incorporate embodiments of the invention described herein, combinations of the same, or the like.

The processor 102 further communicates with the input device 108 to receive information from a user. In certain embodiments, the input device 108 advantageously comprises a standard computer keyboard, such as, for example, a QWERTY keyboard. In other embodiments, the input device 108 comprises other devices capable of receiving input from a user, such as, for example, a keypad (e.g., a cellular phone keypad, or a 10-key numeric pad), a touch screen, a dance pad, a game pad, pedals, a joystick, laser projected keypads, combinations of the same, or the like.

In yet other embodiments, the input device 108 may comprise Dvorak keyboard or a customized keyboard similar to the keyboard illustrated in Appendix A, which is attached hereto and is to be considered a part of this specification. In yet further embodiments, the customized keyboard may include keys that are touch sensitive (e.g., capable of determining how hard a key is being depressed after it has been struck), and/or velocity sensitive (e.g., capable of determining how hard the key is struck), and/or a plug-and-play device.

The illustrated processor 102 also communicates with the display 110 and the audio output device 112. The display 110 can have any suitable construction known to an artisan to display and/or communicate information to a user about the performance of the musical piece. In certain embodiments, the display 110 advantageously comprises an electronic display that indicates to a user what type of user interaction with the input device 108 will generate a particular musical output through the audio output device 112. The audio output device 112 can have any suitable construction known to an artisan to convert electrical signals into sounds loud enough to be heard at a distance. For example, in certain embodiments, the audio output device 112 comprises at least one speaker.

The high-level overview illustrated in FIG. 1 partitions the functionality of the overall music system 100 into modules for ease of explanation. It is to be understood, however, that one or more modules may operate as a single unit. For example, the display 110 and the audio output device 112 can be combined into a single device that performs the functions of both. Conversely, a single module may comprise one or more subcomponents that are distributed throughout one or more locations. For example, the memory 106 can be divided into multiple memory devices such that each stores a portion of the information usable by the music system 100. Further, the communication between the modules may occur in a variety of ways, such as hardware implementations (e.g., over a network, serial interface, parallel interface, or internal bus), software implementations (e.g., database, DDE, passing variables), or a combination of hardware and software.

In yet other embodiments, the electronic music system 100 may include other devices or systems usable in the performance of a musical piece. For example, the music system 100 may further comprise a musical instrument, such as a synthesizer, or other device for activating the action of a traditional instrument, such as the action of a piano, a woodwind, a brass, or a string instrument. In yet other embodiments, the music system 100 may be implemented on a portable computing device (e.g., a laptop, mobile phone, or personal digital assistant), an electronic keyboard, a video game system or console, or the like.

Figure 2:
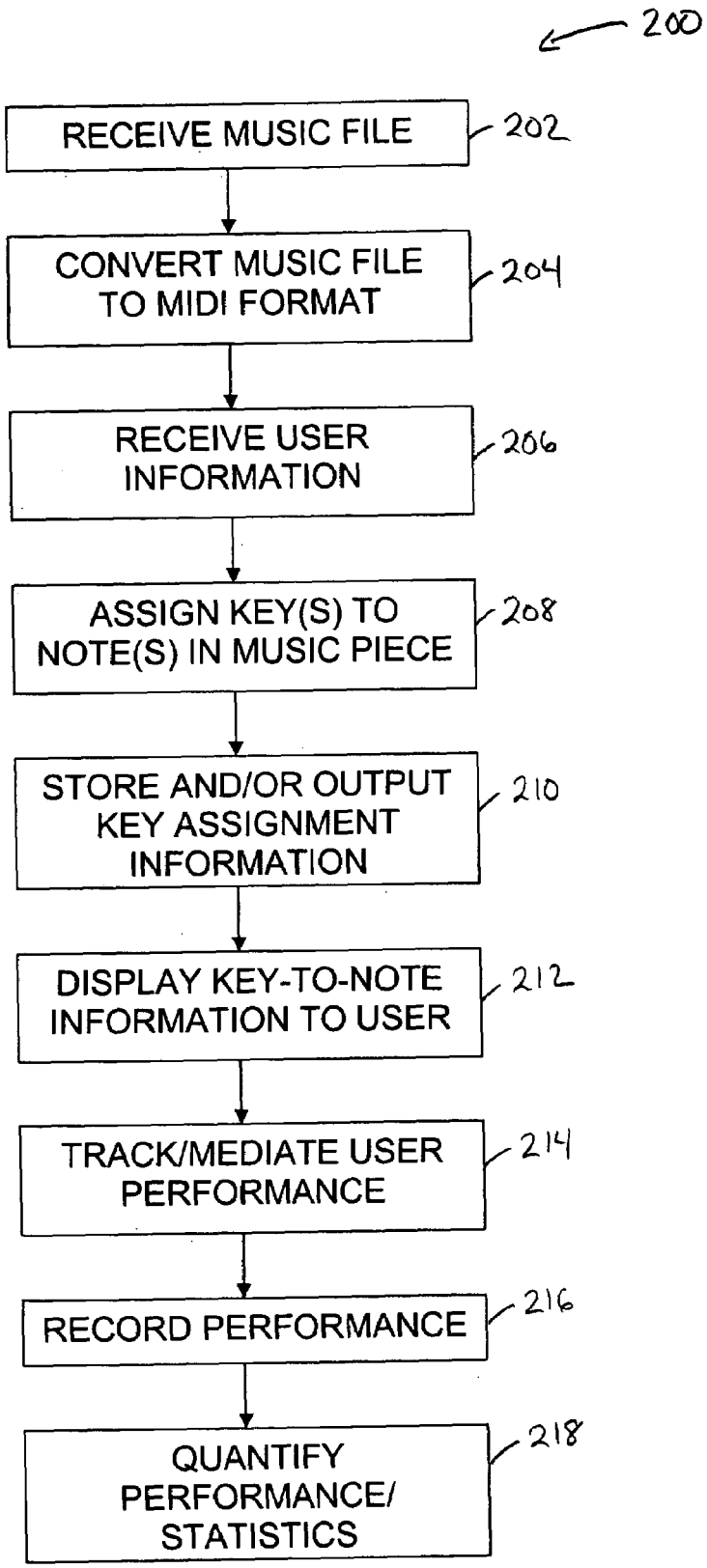
FIG. 2 illustrates a simplified flowchart of an exemplary embodiment of a music performance process executable by the music system of FIG. 1.

FIG. 2 illustrates a simplified flowchart of an exemplary embodiment of a music performance process 200. In certain embodiments, the music system 100 of FIG. 1 executes the process 200 to allow a user to perform a musical piece. For exemplary purposes, the process 200 will be described herein with reference to components of the music system 100 depicted in FIG. 1.

At Block 202, the processor 102 receives the music file 104 having data corresponding to at least one musical piece. The processor 102 may receive the music file 104 from the user, through a wired or wireless network (e.g., the Internet), from a storage device (e.g., the memory 106 or a portable storage device), or the like.

As shown in Block 204, the processor 102 then converts the music file 104 into a format that facilitates the assignment of keys to particular notes of the musical piece. In certain embodiments, the processor 102 accesses the file conversion application 114 in the memory 106 to convert the music file 104 to a MIDI-related format. In such certain embodiments, the converted file may advantageously include data relating to the notes of the musical piece, time stamps of the occurrences of each note, data relating to loudness, combinations of the same, or the like. In further embodiments, the converted file also retains data relating to lyrics of the musical piece, which allows the lyrics to be later displayed to the user when performing the musical piece using the music system 100.

At Block 206, the processor 102 receives information relating to the user. For example, the processor 102 may receive data relating to the user's typing proficiency level (e.g., beginner, intermediate, or advanced typist). In certain embodiments, the processor 102 may retrieve such data directly from the user or may access user profile information recorded in a storage device, such as the memory 106.

At Block 208, the processor 102 assigns keys to occurrences of notes within in the musical piece. In certain embodiments, the processor 102 accesses the fingering assignment application 116 to map occurrences of notes in the musical piece to keys on a keyboard such that the user is able to perform the musical piece by depressing the appropriate keys at appropriate times.

The processor 102 then stores and/or outputs the key assignment information, as is shown in Block 210. In certain embodiments, the processor 102 stores the key assignment information in the memory 106 for later access, such as when the user performs the musical piece. In other embodiments, the processor 102 may be configured to output the key assignment information for use in testing or in modifying key assignment algorithms. In yet further embodiments, the processor 102 may be configured to multiple sets of key assignment information, wherein each set is associated with a certain user proficiency level or difficulty of play.

At Block 212, the key assignment information is displayed to the user, such as through the display 110. In certain embodiments, the display 110 shows alphanumeric symbols, in place of or in addition to traditional music notation, that correspond to particular keys. For example, the display 110 may display a series of keys to be depressed by the user in order to perform the musical piece, such as while executing the performance application 122. In certain embodiments, the display 110 may show multiple keys to be played by each hand of the user or may highlight the key(s) to be currently played by the user and/or dull out those keys already played by the user.

At Block 214, the processor 102 tracks the user performance. This tracking data may be used to customize the key-to-note assignment process according to the particular user's ability. Furthermore, as is shown in Block 216, the processor 102 records the user performance.

In Block 218, the processor 102 quantifies the user performance and outputs statistics relating thereto. Such statistics, in some embodiments, may be used by the user to enhance his or her performance abilities by practicing specifically in areas needing improvement or may be used to customize or modify the key assignment process when it is shown that improbable key assignments are being made.

In certain embodiments, the processor 102 advantageously executes the process 200 as a collection of software instructions written in a programming language. In other embodiments of the invention, the processor 102 implements the process 200 as logic and/or software instructions embodied in firmware or hardware, such as, for example, gates, flip-flops, programmable gate arrays, processors, combinations of the same or the like. Furthermore, the processor 102 may also implement the process 200 as an executable program, installed in a dynamic link library, or as an interpretive language such as BASIC. The process 200 may be callable from other modules or from themselves, and/or may be invoked in response to detected events or interrupts.

Furthermore, the blocks described with respect to the foregoing process 200 are not limited to any particular sequence, and the blocks relating thereto can be performed in other sequences that are appropriate. For example, described blocks may be performed in an order other than that specifically disclosed or may be executed in parallel, or multiple blocks may be combined in a single block. In addition, not all blocks need to be executed or additional blocks may be included without departing from the scope of the disclosure. For example, Blocks 214, 216, and/or 218 may optionally not be executed by the process 200. In yet other embodiments, different systems may execute the Blocks of process 200. For example a first system (e.g., a publishing system) may execute Blocks 202, 204, 206, 208 and 210, and a second system (e.g., an end-user system) may execute Blocks 212, 214, 216 and 218.

Figure 3:
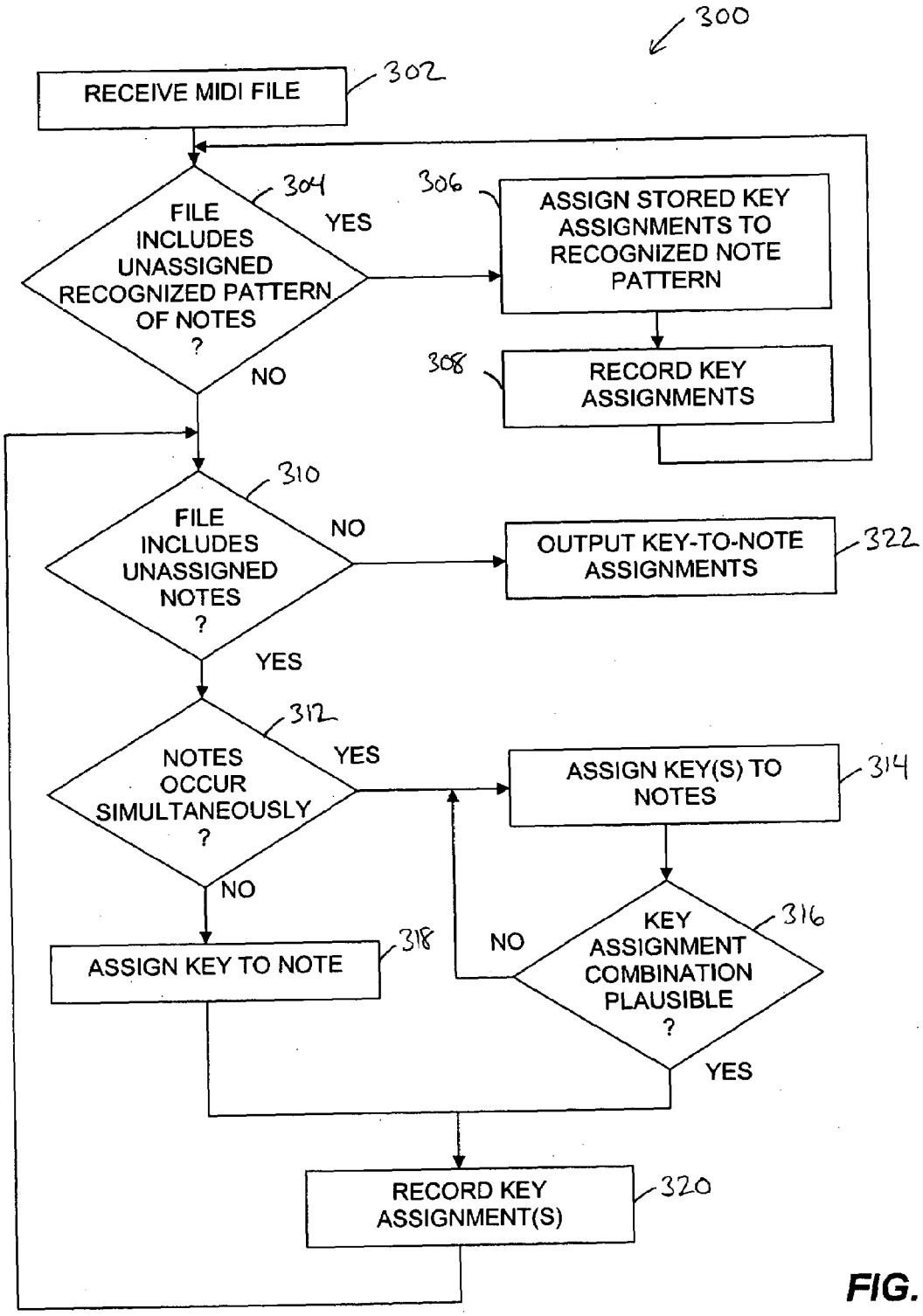
FIG. 3 illustrates a flowchart of an exemplary embodiment of a key-mapping process usable in the music performance process of FIG. 2.

FIG. 3 illustrates a flowchart of an exemplary embodiment of a key-mapping process 300 usable in the music performance process 200 of FIG. 2. In particular, at least a portion of the key-mapping process 300 may be performed during the execution of Block 208 of the music performance process 200. For exemplary purposes, the process 300 will be described herein with reference to components of the music system 100 depicted in FIG. 1.

At Block 302, the processor 102 receives a MIDI file to be processed. In certain embodiments, the MIDI file includes a series of notes to be assigned or mapped to keys such that a user can perform a musical piece by depressing the appropriate keys.

At Block 304, the processor 102 determines if the MIDI file includes a recognized pattern of multiple notes. For example, the processor 102 may search the MIDI file for recognized chords or for patterns of note sequences. In certain embodiments, the processor 102 compares stored note patterns and/or chords, which can be updated and/or stored in the memory 106, with the sequences of notes in the MIDI file. In yet further embodiments, such stored patterns are updatable or may be modified by the user.

For example, in one embodiment, the processor 102 may search the MIDI file for occurrences of a "C" chord (the notes "C," "E," and "G" occurring together). For each occurrence of the "C" chord, the processor 102 then assigns a particular key or set of keys to the chord. For example, the processor 102 may assign the keys "J," "K," and "L" to each occurrence of the "C" chord. In other embodiments, other chords or commonly repeated note sequences may be identified by the processor 102.

In yet other embodiments, the processor 102 may assign more or fewer keys than the number of notes in the associated chord or note sequence. For example, the processor 102 may assign the keys "J" and "K," or just "J" or "K," to correspond to occurrences of the "C" chord.

If the MIDI file does include a recognized pattern of multiple notes, the processor 102 assigns the corresponding stored key assignments to the recognized note pattern, as is shown in Block 306. Once the key assignments are made, the process 300 proceeds with Block 308, wherein the processor 102 records the key assignments and their associated sequence of notes. The process 300 then returns to Block 304 to search the MIDI file for additional unassigned and recognized patterns of multiple notes.

If the MIDI file does not contain unassigned, recognized patterns of multiple notes, the process 300 continues with Block 310. At Block 310, the processor 102 determines if there are other unassigned occurrences of notes in the MIDI file. If there are additional unassigned occurrences of notes, the processor 102 determines if any of the unassigned notes occur simultaneously, as shown in Block 312. For example, the processor 102 may access time stamp information stored in the MIDI file that identifies at what point of the musical piece each note occurs.

If multiple unassigned notes do occur at the same time, the process moves to Block 314, wherein the processor 102 assigns at least one key to the plurality of simultaneously occurring notes. At Block 316, the processor 102 then determines if the key assignment combination is plausible. For example, the processor 102 may determine if the key assignment combination violates one of the assignment rules 120, which may include, for example, the following:

a) The same key should not be simultaneously assigned to multiple fingers;

b) The same finger should not be simultaneously assigned to multiple keys;

c) The distance between two simultaneously assigned keys should not extend further than a certain distance (e.g., the finger span of the user);

d) The finger travel time between two subsequent key assignments should not be less than a threshold amount, such as, for example, the time generally needed for a finger to complete a first assignment, to return to the home row, and to move into position to strike the next note at the correct time; and e) The simultaneously assigned keys should not result in unnatural and/or uncomfortable hand or finger positioning (e.g., requiring the user to use the fingers of his or her right hand to simultaneously depress the "N," "M," "I," and "O" keys).

If the key assignment combination is not plausible, the process 300 returns to Block 314 for assignment of an alternative key combination to the particular notes. If the key assignment combination is plausible, then the process 300 proceeds with Block 320, wherein the key assignments are recorded.

With reference to Block 312, if a remaining unassigned note does not occur simultaneously with another note, the process 300 continues to Block 318. At Block 318, the processor 102 assigns at least one key to the particular note, which key assignment is then recorded, as shown in Block 320.

After the processor 102 records the particular key assignment(s), the process 300 returns to Block 310 to determine if the file includes additional unassigned notes. If all the notes have been assigned, the process 300 terminates by outputting the recorded key-to-note assignments, as is shown in Block 322.

Although disclosed with reference to particular embodiments, a wide variety of alternative embodiments exist for the process 300. For example, in other embodiments, data file types other than a MIDI file type may be used, examples of which are discussed above. Furthermore, the blocks described with respect to the process 300 are not limited to any particular sequence, and the blocks relating thereto can be performed in other sequences that are appropriate. For example, described blocks may be performed in an order other than that specifically disclosed or may be executed in parallel, or multiple blocks may be combined in a single block. In addition, not all blocks need to be executed or additional blocks may be included without departing from the scope of the disclosure.

Figure 4:
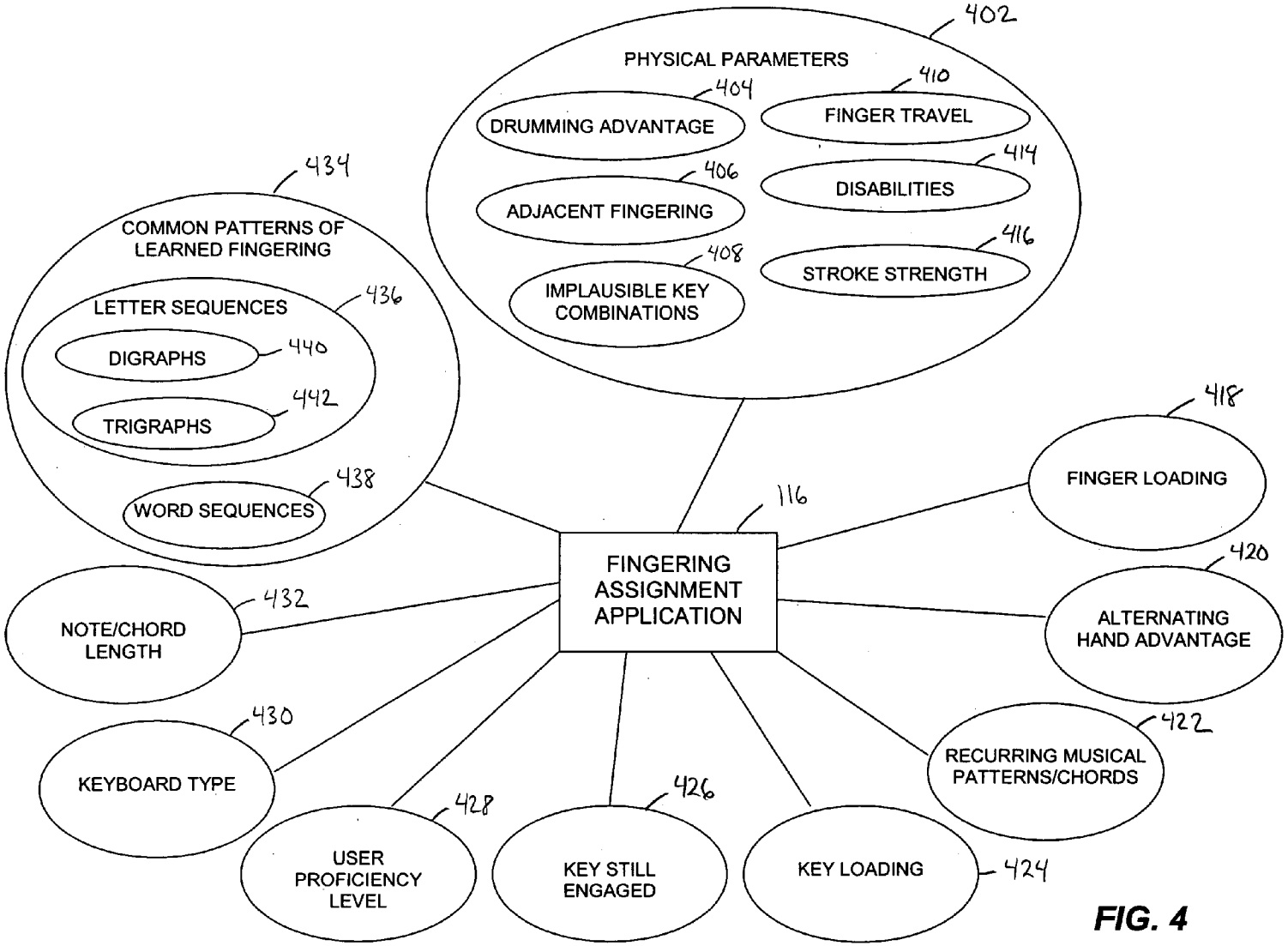
FIG. 4 illustrates a diagram of a plurality of factors usable to determine a key-to-note assignment, according to an embodiment of the invention.

In certain embodiments, multiple factors may be considered when assigning a particular key to a particular occurrence of a note. FIG. 4 illustrates a plurality of factors that may be considered by the processor 102 when executing the fingering assignment application 116 to make a key assignment. It should be recognized that the fingering assignment application 116 need not consider all the identified factors when making key assignments. Furthermore, the grouping and/or organization of the factors illustrated by FIG. 4 is for exemplary purposes and, in other embodiments, alternative groupings may exist, or the fingering assignment application 116 may consider other factors not specifically identified in FIG. 4.

As illustrated, the fingering assignment application 116 may take into account one or more physical parameters 402 when assigning at keys to occurrences of notes. In certain embodiments, the physical parameters 402 include factors that relate to the positioning, movement, or use of the user's fingers to depress particular assigned keys.

As shown, the physical parameters 402 include the following factors: a drumming advantage 404 (e.g., a natural tendency for a person to tap his or her fingers in succession from the little finger to the index finger), such as for trills and/or rolls of a musical piece; adjacent fingering 406 (e.g., assigning of finger other than adjacent finger to subsequent note); implausible key combinations 408; finger travel 410, which includes the distance a particular finger travels between consecutive keys and/or the distance of an assigned key from a particular default location (e.g., the home row of a QWERTY keyboard); disabilities 414 of the user; and a stroke strength 416 (e.g., a finger strength and/or a repetitive stroking strength) of a designated finger.

The illustrated fingering assignment application 116 may also take into account a finger loading factor 418. For example, if a particular finger is being used substantially more than a user would generally use the same finger in a conventional typing environment, the fingering assignment application 116 may determine that keys surrounding the particular finger should be assigned less frequently. In yet other embodiments, the finger loading factor 418 may be used to determine if a particular finger is being used at a higher frequency than such a finger would be used in an improved finger usage arrangement. An example of such an improved finger usage arrangement is described in *Typewriting Behavior*, by August Dvorak et al., published by American Book Company (New York: 1936), which is hereby incorporated herein by reference in its entirety.

As shown, the fingering assignment application 116 may also make key-to-note assignments based on an alternating hand advantage factor 420. In certain embodiments, the alternating hand advantage factor 420 indicates that alternating key assignments between fingers of different hands, in some circumstances, allows the user to play a musical sequence more rapidly or fluidly. In such situations, the user may need to only move one hand at a time. In yet other embodiments, keys associated with the fingers of the user's right hand may be assigned to notes in the melody while keys associated with the fingers of the user's left hand are associated with notes in chords accompanying the melody.

A recurring musical pattern/chord factor 422 may be used to assign the same keys to musical patterns and/or chords that are repeated during a particular musical piece or that are frequently used in music in general.

The fingering assignment application 116 may also take into account a key loading factor 424. Such a factor is used to determine if a particular key is being assigned during a certain musical piece at a higher frequency than such a key would be used in a conventional typing setting. In other embodiments, the key loading factor 424 may be used to determine if a particular key is being assigned during a certain musical piece at a higher frequency than such a key would be used in an improved key usage setting, such as is described in *Typewriting Behavior*, by August Dvorak et al.

A key-still-engaged factor 426 alerts the fingering assignment application 116 that a particular key is assigned to a particular note during a particular portion of the musical piece. Such a factor helps prevent the same key from being concurrently assigned to multiple notes and the same finger from being concurrently assigned to multiple keys. In embodiments of the invention wherein the same key is intended to be assigned to multiple notes at the same time (e.g., a chord), the key-still-engaged factor 426 may be at least temporarily ignored or overridden.

As shown in FIG. 4, the fingering assignment application 116 may also receive information regarding a user proficiency level 428. In certain embodiments, the user proficiency level factor 428 is used to determine which keys of a keyboard are to be designated for key assignments during the performance of a musical piece. For example, the higher the proficiency level of the user, the greater the number of keys that may be selected as being available for key-to-note assignment(s).

In one embodiment, the user may be classified according to one of four proficiency levels: beginner, intermediate, advanced, and expert. For a beginner, the user proficiency level factor 428 may indicate that only alphanumeric keys on the home row (i.e., a, s, d, f, g, h, j, k, l, ;, and ') are to be used in the key-to-note assignments. This enables the beginner user to focus on a select number of learned keys when performing the musical piece.

For an intermediate level user, the proficiency level factor 428 may indicate that alphanumeric keys on the home row and the row above the home row are to be used, while an advanced user may be assigned alphanumeric keys from the home row and the rows above and below the home row. Furthermore, the expert user may be assigned any of the alphanumeric keys from the keyboard.

With continued reference to FIG. 4, the fingering assignment application 116 may take into account the keyboard type 430. For example, fingering assignments may be based on what type of keyboard, examples of which are listed above, the user is using to perform the musical piece.

A note/chord length factor 432 may also be used by the fingering assignment application 116 to assign a particular key. For example, the fingering assignment application 116 may consider how long a particular note/chord is to be played when determining the key-to-note assignments.

As shown, the fingering assignment application 116 may also take into account factors relating to common patterns of learned fingering 434. In certain embodiments, such common patterns include combinations of alphanumeric characters that have a high frequency of use in a particular language. In general, a user is more accustomed to typing such keys together or in succession when using a keyboard.

As illustrated, in certain embodiments, the common patterns 434 include letter sequences 436 and word sequences 438. Letter sequences 436 further include digraphs 440 and trigraphs 442. Digraphs 440 include two-letter combinations that represent a single speech sound, such as, for example, "ch," "ea," "th," and "ou." Similarly, trigraphs include three-letter combinations that represent a single speech sound, such as, for example, "sch," "igh," and "eau."

Commonly used word sequences 438 advantageously include short words of four letters or less, such as, for example, "an," "the," "no," and "when" that are frequently used in a particular language. In yet other embodiments, the word sequences 438 may include commonly used words of more than four letters.

In certain embodiments, the processor 102 executes the fingering assignment application 116 to access at least one of these factors when making a key-to-note assignment. Furthermore, one or more of the factors illustrated in FIG. 4 may be implemented by the fingering assignment application 116 through a decision tree approach, a rule based approach, a neural approach, combinations of the same, or the like.

Figure 5:
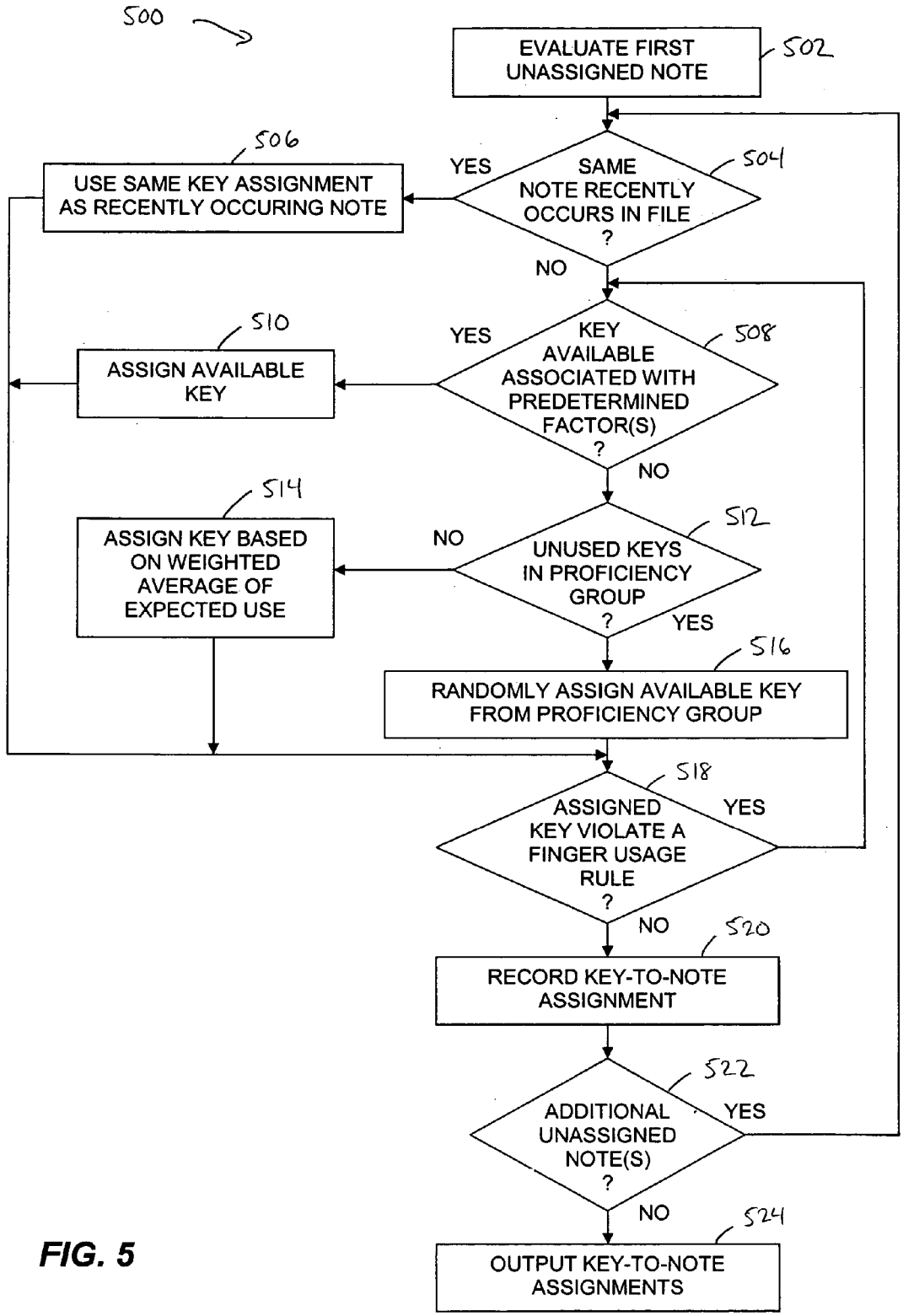
FIG. 5 illustrates a flowchart of an exemplary embodiment of a key-to-note assignment process usable in the key-mapping process of FIG. 3.

FIG. 5 illustrates a flowchart of an exemplary embodiment of a key-to-note assignment process 500 usable in the key-mapping process 300 of FIG. 3. In particular, at least a portion of the key-to-note assignment process 500 may be performed during the execution of Block 318 of the key-mapping process 300. For exemplary purposes, the process 500 will be described herein with reference to components of the music system 100 depicted in FIG. 1.

In certain embodiments, the key-to-note assignment process 500 is automatically performed to assign fingering for the performance of a musical piece. In particular, the process 500 may be performed to dynamically assign keys of a keyboard to occurrences of notes within a particular musical piece.

The process 500 begins with Block 502, wherein the processor 102 evaluates the first unassigned occurrence of a note of a data file corresponding to at least one musical piece, such as a MIDI file that was converted from the music file 104. In one embodiment, the processor 102 sequentially moves through the data file until the processor 102 encounters the first unassigned occurrence of the note.

At Block 504, the processor 102 determines if the subject note is the same as one that recently occurred in the data file. For example, if the subject note corresponds to a "C," the processor 102 may determine if a "C" note occurred within the last five notes, bars, or measures of the musical piece. In other embodiments, other ranges such as greater than five measures or less than five measures, may be used.

If the same note has recently occurred, the process 500 proceeds with Block 506, wherein the processor 102 assigns to the subject note the same key that was assigned to the previously occurring note. Such an assignment allows a user to experience a sense of consistency between key assignments of identical notes that occur close in time to each other and to more easily memorize the key/note assignment sequence of a piece.

If the same note has not recently occurred, the process 500 proceeds with Block 508, wherein the processor 102 determines if there is an available key that is associated with one or more predetermined factors. For example, the processor 102 may evaluate the available keys according to one or more of the factors shown in FIG. 4. In certain embodiments, the processor 102 advantageously determines if an available key is associated with a common pattern of learned fingering, as described with reference to the learned fingering factors 434 of FIG. 4. In yet further embodiments, the processor 102 may also consider factors such as physical capabilities of the user, including drumming advantage factors 404 and/or adjacent fingering factors 406, as described with reference to FIG. 4.

If there is an available key that is associated with a predetermined factor, the processor 102 assigns the available key to the occurrence of the note, as is shown in Block 510. If none of the available keys are associated with a predetermined factor, then the process moves to Block 512, wherein the processor 102 determines if there are any remaining unused keys in the proficiency group associated with the user.

For example, in certain embodiments, the user may initially be associated with a particular proficiency level based at least in part upon his or her typing skill and/or familiarity with the music performance program. As described above, in certain embodiments, the user may be classified within one of multiple proficiency levels (e.g., beginner, intermediate, advanced, and expert), each of which is associated with a particular group of keys that are available to be assigned to notes of a musical piece.

In an embodiment, a lower proficiency level (e.g., beginner) is associated with a relatively small number of keys. Such an embodiment facilitates user performance of the musical piece because of the limited number of keys that are assigned to notes. For example, a beginner level proficiency group may include only the alphanumeric keys on the home row of a QWERTY keyboard and/or one key may represent multiple notes, such as, for example, a sequence of notes.

Likewise, a higher proficiency level (e.g., expert) is associated with a relatively large number of keys. Such an embodiment increases the challenge of performing the musical piece by increasing the number of keys available to be assigned to occurrences of notes. For example, an expert level proficiency group may be assigned to all the alphanumeric keys on a QWERTY keyboard.

In other embodiments, the proficiency group keys may be selected through other methods. For example, the user may be prompted to select which keys he or she would like to use during the performance of the musical piece.

If at Block 512 the processor 102 determines that at least one of the keys from the user proficiency group has not yet been used (e.g., previously assigned to an occurrence of a note in the subject musical piece), the process 500 continues with Block 514. Such a determination ensures, subject to other key assignment rules, that each of the keys of the subject proficiency group is used prior to any key being assigned a second time. In one embodiment, such a determination is limited to whether each key of the proficiency group has been used in an assignment with a single note. In other embodiments, the processor 102 may determine whether each of the proficiency group keys has been previously assigned at any time during the musical piece (e.g., assignment to a chord or to a predetermined note sequence).

If all the keys of a proficiency group have been used, the process 500 proceeds to Block 514, wherein the processor 102 assigns the subject note a key based on the weighted average of the desired or expected use of the key. For example, in certain embodiments, the music system 100 accesses data indicative of the frequency of use of each alphanumeric key of a keyboard during general typing. Such data may be independently derived by the music system 100 or may be acquired from other sources. The processor 102 then uses this data to determine key-to-note assignments.

For example, the letters "E, "S," and "A" generally occur more often in spoken and written communication than the letters "Q," "X," and "K." Thus, in one embodiment, the keys with the letters "E," "S," and "A" are more frequently assigned to occurrences of notes than the keys with the letters "Q," "X," and "K." In making a key assignment, the processor 102 may receive data concerning the expected frequency of occurrence of each alphanumeric character whose key is in the subject proficiency group, and then the processor 102 may make key assignments to approximate such expected occurrences. In such an embodiment, the performance of a musical piece may feel more natural to a user because he or she is using certain keys and/or fingering with the approximately the same frequency that he or she would be using the keys and/or during conventional typing exercises.

With continued reference to Block 514, in one embodiment, the processor 102 may assign to the subject note the key with the greatest difference between its expected occurrence (from stored data) and its current frequency of use in key assignments for note occurrences of the subject musical piece. In other embodiments, in Block 514, key assignments may be randomly made between the available keys such that the keys with a greater discrepancy between expected occurrence and current frequency of use are given a higher weight or probability of being selected.

With reference to Block 512, if there still remains at least one unused key of the proficiency group, the process 500 proceeds to Block 516. At Block 516, the processor 102 randomly assigns the subject note an unused key from the proficiency group.

Once a key has been preliminarily assigned to a note, whether such assignment occurs in Blocks 506, 510 or 514, the process 500 continues with Block 518. At Block 518, the processor 102 determines if the temporary key-to-note assignment violates a finger usage rule. In certain embodiments, the processor 102 accesses at least one of the assignment rules 120 to make such a determination. For example, the processor 102 may determine if the key assignment would result in an implausible key combination or sequence, such as requiring the user to position his or her finger(s) in an unnatural or uncomfortable manner or requiring too far of finger travel between sequential key assignments. The processor 102 may also determine if the assigned key is already being used or may take into account certain physical disabilities of the user.

If the assigned key violates a finger usage rule, the process 500 returns to Block 508 to determine if another key is available that is associated with a predetermined factor. Furthermore, to avoid re-assignment of the same key that violated the finger usage rule, the processor 102 may temporarily record information regarding the particular key in a cache or memory. In such an embodiment, the processor 102 may "remove" the key from the available pool of keys for assignment to the subject note.

If the assigned key does not violate a finger usage rule, the processor 102 then records the key-to-note assignment, as shown in Block 520. The processor 102 then determines if there is at least one unassigned occurrence of a note in the data file, as shown in Block 522.

If there is an additional unassigned note, the process 500 returns to Block 504. If all occurrences of notes in the data file have been assigned to keys, the processor 102 outputs the key-to-note assignments (Block 524).

Although the foregoing process 500 has been described with reference to particular embodiments, alternative methods or functions may be used. For example, instead of at Block 518 randomly assigning an available key from a proficiency group, the processor 102 may follow a predetermined pattern of key assignments until all the keys of the proficiency group have been used. For instance, the processor 102 may assigned the first unassigned note an "A" key, the second unassigned note an "S" key, the third unassigned note a "D" key, and so forth.

Furthermore, the blocks described with respect to the foregoing process 500 are not limited to any particular sequence, and the blocks relating thereto can be performed in other sequences that are appropriate. For example, described blocks may be performed in an order other than that specifically disclosed or may be executed in parallel, or multiple blocks may be combined in a single block. In addition, not all blocks need to be executed or additional blocks may be included without departing from the scope of the disclosure.

Furthermore, while certain embodiments of the inventions have been described, these embodiments have been presented by way of example only, and are not intended to limit the scope of the inventions. Other embodiments of the invention, including exemplary graphs, charts and screen displays are attached hereto as Appendix B and are hereby incorporated herein by reference to be considered a part of this specification. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A method of assigning keyboard fingering for a performance of a musical piece, the method comprising:

receiving a file comprising data associated with a plurality of notes of a musical piece;

assigning a first key having a first position on a keyboard to a first note of the plurality of notes, wherein the first note has a first pitch;

assigning a second key having a second position on the keyboard to a second note of the plurality of notes, wherein the second note has the same pitch as the first note and wherein said assigning of the second key comprises at least determining a positional relationship between the second key and another key on the keyboard; and assigning to a user one of a plurality of proficiency levels, wherein each of the plurality of proficiency levels is associated with a different predetermined number of keys of the keyboard to be assigned to the plurality of notes.

2. A method of assigning keyboard fingering for a performance if a musical piece, the method comprising:

receiving a file comprising data associated with a plurality of notes of a musical piece;

assigning a first key having a first position on a keyboard to a first note of the plurality of notes, wherein the first note has a first pitch;

assigning a second key having a second position on the keyboard to a second note of the plurality of notes, wherein the first key and the second key are each associated with an alphanumeric character, wherein the second note has the same pitch as the first note, wherein said assigning of the second key further comprises;

determining a positional relationship between the second key and another key on the keyboard, and determining if the alphanumeric character associated with the second key forms a predetermined letter sequence with an alphanumeric character associated with another key of the keyboard.

3. A method of assigning keyboard fingering for a performance of a musical piece, the method comprising: receiving a file comprising data associated with a plurality of notes of a musical piece;

assigning a first key having a first position on a keyboard to a first note of the plurality of notes, wherein the first note has a first pitch; and assigning a second key having a second position on the keyboard to a second note of the plurality of notes, wherein the second note has the same pitch as the first note, wherein said assigning of the second key comprises determining a position relationship between the second key and another key on the keyboard, and wherein the second key is one of a group of keys having not been assigned, immediately prior to said assigning the second key, to one of the plurality of notes of the musical place.

4. The method of claim 3, wherein said of assigning the second key comprises randomly selecting an available key from the group of unassigned keys.

5. The method of claim 4, wherein said assigning of the second key comprises selecting the second key based at least on a difference between an expected frequency of use of the second key and an actual frequency of assignment of the second key to notes in the musical piece.

6. A method of assigning keyboard fingering for a performance of a musical piece, the method comprising:

receiving a file comprising data associated with a plurality of notes of a musical piece;

assigning a first key of a keyboard to a first note of the plurality of notes, wherein the first note has a first pitch;

assigning the first key to a second note of the plurality of notes, wherein the second note has a different pitch than the, first note and wherein said assigning of the first key to the second note comprises determining a positional relationship between the first key and another key on the keyboard; and reassigning a second key of the keyboard to the second note if said assigning of the first key to the second note violates at least one predetermined rule.

7. The method of claim 6, wherein the at least one predetermined rule comprises data relating to key combinations that correspond to implausible finger positions.

8. A computer-readable medium storing a machine loadable software program for assigning fingering for a performance of a musical piece, the computer-readable medium comprising:

first software instructions that assign a first key having a first location on a keyboard to an occurrence of a first note of a musical piece;

second software instructions that assign a second key having a second location on the keyboard to an occurrence of a second note of the musical piece; and third software instructions that determine if the first location and the second location comprise an implausible key combination and that store in a memory said key assignments if the implausible key combination does not exist.

9. The computer-readable medium of claim 8, wherein the second software instructions are further configured to assign a third key to the occurrence of the second note if the third software instructions determine that the implausible key combination exists.

10. The computer-readable medium of claim 8, wherein the second software instructions are configured to assign the second key to the occurrence of the second note based at least in part on a comparison between an expected usage of an alphanumeric character associated with the second key and an actual frequency of assignment of the second key to occurrences of notes of the musical piece.

11. The computer-readable medium of claim 8, wherein the third software instructions are configured to determine if the implausible key combination exists by determining if a distance between the first location and the second location exceeds a threshold amount.

12. The computer-readable medium of claim 8, wherein the third software instructions are configured to determine if the implausible key combination exists by determining if the first location and the second location correspond to a predetermined pattern identified as an unnatural hand position.

* * * * *

UNITED STATES PATENT AND TRADEMARK OFFICE

CERTIFICATE OF CORRECTION

PATENT NO. : 7,202,408 B2
APPLICATION NO. : 11/111638
DATED : April 10, 2007
INVENTOR(S) : James Calvin Fallgatter It is certified that error appears in the above-identified patent and that said Letters Patent is hereby corrected as shown below:

Title Page Col. 2 (Other Publications), line 1, please delete "Typewritting Behavoir," and insert --"Typewriting Behavior," --, therefor.

At column 15, line 14, in Claim 2, please delete "if" and insert -- of --, therefor.

At column 15, line 25, in Claim 2, please delete "comprises;" and insert -- comprises: --, therefor.

At column 15, line 43, in Claim 3, please delete 'position" and insert -- positional --, therefor.

At column 15, line 48, in Claim 3, please delete "place." and insert -- piece. --, therefor.

At column 16, line 7 (Approx.), in Claim 6, please delete "the," and insert -- the --, therefor.

Signed and Sealed this

Twenty-third Day of October, 2007

JON W. DUDAS
*Director of the United States Patent and Trademark Office*